US010126697B2

(12) United States Patent
Okada

(10) Patent No.: US 10,126,697 B2
(45) Date of Patent: Nov. 13, 2018

(54) IMAGE FORMING APPARATUS

(71) Applicant: CANON KABUSHIKI KAISHA, Tokyo (JP)

(72) Inventor: Noriyuki Okada, Matsudo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/869,841

(22) Filed: Jan. 12, 2018

(65) Prior Publication Data

US 2018/0203394 A1 Jul. 19, 2018

(30) Foreign Application Priority Data

Jan. 18, 2017 (JP) ..... 2017-007061

(51) Int. Cl.
*G03G 15/08* (2006.01)
*G03G 15/00* (2006.01)
*G03G 15/01* (2006.01)

(52) U.S. Cl.
CPC ..... *G03G 15/556* (2013.01); *G03G 15/0121* (2013.01); *G03G 15/5041* (2013.01); *G03G 15/553* (2013.01)

(58) Field of Classification Search
CPC ..... G03G 15/0121; G03G 15/5041; G03G 15/553; G03G 15/556
See application file for complete search history.

(56) References Cited

U.S. PATENT DOCUMENTS 6,181,888 B1 * 1/2001 Scheuer ..... G03G 15/01 399/49
7,949,276 B2 * 5/2011 Morikawa ..... G03G 15/5041 399/72
2011/0280594 A1 11/2011 Tanaka

FOREIGN PATENT DOCUMENTS

JP 10-039608 A 2/1998
JP 2005099142 A 4/2005
JP 2008015260 A 1/2008
JP 2009-186782 A 8/2009
JP 2011-048118 A 3/2011

* cited by examiner

*Primary Examiner* — Hoang Ngo
(74) *Attorney, Agent, or Firm* — Canon U.S.A., Inc. IP Division

(57) ABSTRACT

An image forming apparatus includes a control unit configured to be able to perform density adjustment control of forming a reference toner image for image density control on an image bearing member and changing a target value of a toner density based on an image density of the reference toner image detected by an image density detection unit. The control unit limits the target value of the toner density within a predetermined range, and changes frequency of execution of the density adjustment control based on the fact that the target value of the toner density is placed at a boundary value.

11 Claims, 14 Drawing Sheets

IMAGE FORMING APPARATUS

BACKGROUND OF THE INVENTION

Field of the Invention

The present invention relates to an image forming apparatus.

Description of the Related Art

Generally, development devices provided to image forming apparatuses such as copy machines and printers employing the electrophotographic method or the electrostatic recording method use a mono-component developer mainly including magnetic toner or a two-component developer mainly including non-magnetic toner and a magnetic carrier. Especially, in image forming apparatuses forming a full-color or multi-color image by the electrophotographic method, most development devices use the two-component developer in light of, for example, a hue of an image.

In the case where the above-described two-component developer is used, toner density in the two-component developer (a ratio of toner weight (T) to total weight of the carrier and the toner (D): a TD ratio) is an extremely important element in stabilizing image quality. Because the toner is consumed at the time of the development of an image, the toner density in the above-described development device is being undesirably reduced unless the toner is replenished. Therefore, conventionally, there has been proposed an image forming apparatus including a density control device configured to detect the toner density in the above-described development device and keep this toner density constant (Japanese Patent Application Laid-Open No. 10-039608). More specifically, the density control device discussed in the above-described patent literature, Japanese Patent Application Laid-Open No. 10-039608 is constructed by combining methods called developer density detection Automatic Toner Replenishment (ATR), video count ATR, and patch detection ATR.

The developer density detection ATR is a method that detects the toner density in the developer in the development device from a reflection light amount of the developer or a magnetic permeability of the developer with the use of a toner density sensor, and controls the toner density based on a result of the detection by this toner detection sensor. Further, video count ATR is a method that calculates a required toner amount based on an output level of a digital image signal for each pixel from a video counter to control the toner density. Further, patch detection ATR is a method that forms an image density detection image pattern (a patch image) for reference on an image bearing member, detects an image density thereof with use of a sensor such as an image density sensor mounted facing the image bearing member, and controls the toner density.

The density control device discussed in Japanese Patent Application Laid-Open No. 10-039608 determines a toner replenishment amount according to the developer density detection ATR and the video count ATR. Further, this density control device is configured to carry out patch detection ATR at a predetermined timing, and corrects the developer density detection ATR or the video count ATR based on density information of this patch detection ATR.

The developer density detection ATR directly detects the toner density in the developer in the development device, and therefore can keep the toner density in the developer constant. However, the frictionally charged amount of the toner changes due to an alteration of properties of the magnetic carrier in the developer, a change in the environment, and the like, and thus developability changes accordingly. Therefore, even when the toner density in the developer is kept constant, image density may be changed if the properties of the carrier are altered and/or the environment is changed.

Further, video count ATR converts density information of an image on an original document into a video count number, predicts a toner consumption amount from this value, and replenishes the toner by an amount corresponding to a predicted change in the toner density in the developer from an initial setting value. Therefore, if there is a change in a toner replenishment amount related to consumption, the toner density in the developer may deviate from the initial setting value by an amount corresponding to this change.

On the other hand, the patch detection ATR detects the image density of the actual patch image. Therefore, the density control device discussed in the above-described patent literature, Japanese Patent Application Laid-Open No. 10-039608 makes it possible to correct a target value from developer density detection ATR or video count ATR by combining this patch detection ATR.

However, according to patch detection ATR, if a low density patch image is acquired due to a reduction in the developability caused by an increase in the frictionally charged amount of the toner, ATR operates to make a determination from this low density and thus continues toner replenishment. Further, if a high density patch image is acquired due to an increase in the developability caused by a reduction in the frictionally charged amount of the toner, ATR operates to make a determination from this high density and thus stops toner replenishment. Continuously replenishing the toner or stopping the replenishment of the toner in this manner may bring about a situation in which toner is replenished more than necessary or toner replenishment falls short, thereby raising the possibility of impairing the stability of the developed image.

Therefore, conventionally, it has been proposed to set upper and lower limit values on a range of a change in the target value of the developer density detection ATR, and to prevent the developer density from being excessively increased/reduced even when the image density is determined to be light/dark as a result of the patch detection ATR (Japanese Patent Application Laid-Open No. 2011-48118).

Setting the upper and lower limit values on the range of the change in the target value of the developer density detection ATR in this manner can prevent the developer density from being excessively increased or reduced. However, when the target value of the developer density detection ATR matches the upper or lower limit value, the target value of the developer density detection ATR may remain unchanged even when patch detection ATR is carried out. As a result, it may be useless to carry out patch detection ATR.

SUMMARY OF THE INVENTION

The present invention is directed to providing an image forming apparatus capable of reducing frequency at which the patch image for adjusting the developer density is formed.

According to an aspect of the present invention, an image forming apparatus includes a developer containing unit configured to contain therein a developer including toner and a carrier, a developer bearing member configured to bear the developer in the developer containing unit, a toner density detection unit configured to detect the density of the toner relative to the developer in the developer containing unit, a toner replenishment unit configured to replenish the toner into the developer containing unit, an image density detection unit configured to detect the density of density detection toner images developed by the developer bearing member at a preset interval, a control unit configured to control the replenishing of the toner, by the toner replenishment unit, into the developer containing unit so as to maintain toner density, detected by the toner density detection unit, at a target value, wherein the control unit is further configured to set the target value of the toner density to a value that is a preset lower limit value or higher and a preset upper limit value or lower based on an output of the image density detection unit, and wherein the control unit is further configured to set the interval to the first interval when the target value is set to a value higher than the lower limit value and lower than the upper limit value, and to set the interval to a second interval greater than the first interval when the target value setting unit sets the target value to the upper limit value or the lower limit value.

Further features of the present invention will become apparent from the following description of exemplary embodiments with reference to the attached drawings. Each of the embodiments of the present invention described below can be implemented solely or as a combination of a plurality of the embodiments. Also, features from different embodiments can be combined where necessary or where the combination of elements or features from individual embodiments in a single embodiment is beneficial.

DESCRIPTION OF THE EMBODIMENTS

The present invention will be described in detail based on exemplary embodiments illustrated in the accompanying drawings with reference to the drawings. Numerical values that will be described in the present exemplary embodiments are setting conditions for implementing the present exemplary embodiments, and may be replaced with other numerical values.

[Overall Configuration of Image Forming Apparatus]

Figure 1:
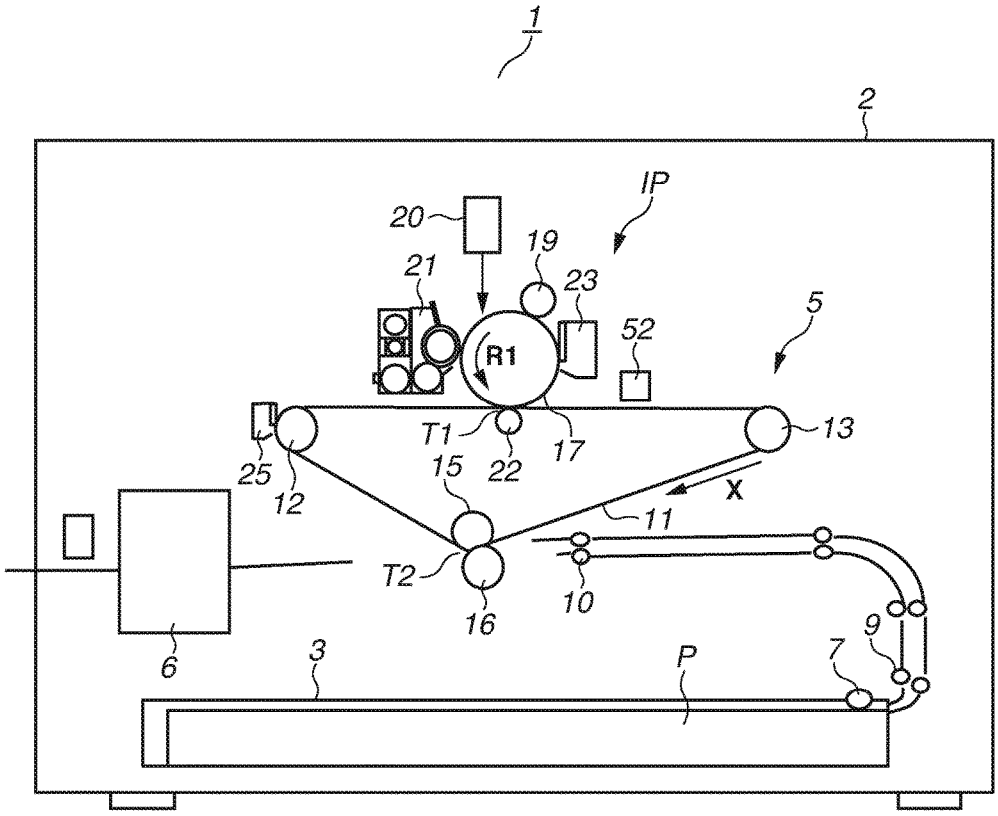
FIG. 1 is a schematic diagram illustrating a printer according to a first exemplary embodiment.

FIG. 1 is a schematic diagram illustrating an outline of a configuration of a digital electrophotographic printer 1 as an image forming apparatus according to a first exemplary embodiment, and the printer 1 includes a sheet cassette 3 as a sheet containing unit where a sheet P is contained at a lower portion of an apparatus main body 2. Further, an image forming unit 5, which forms an image onto the sheet P, and a fixing device 6, which fixes a toner image formed on the sheet P, are provided above the sheet cassette 3.

The sheet P stacked in the sheet cassette 3 is fed by a pickup roller 7 forming a sheet feeding unit, and then conveyed toward a registration roller 10 by a conveyance roller 9. The sheet P is conveyed to a secondary transfer nip T2 in synchronization with an image forming timing in the above-described image forming unit 5, while being corrected from a skewed state by the registration roller 10. The toner image formed by the image forming unit 5 is transferred onto the sheet P at the secondary transfer nip T2, and the sheet P is conveyed toward the fixing device 6. The sheet P with the unfixed toner image transferred thereon is pressurized and heated at the fixing device 6, by which the toner image is fixed onto the sheet P. Then, the sheet P is discharged onto a sheet discharge tray by a not-illustrated discharge roller.

Subsequently, a configuration of the above-described image forming unit 5 will be described in detail. The image forming unit 5 includes an endless intermediate transfer belt 11, which runs in a direction indicated by an arrow X, and four image forming units IP, which are arranged along this intermediate transfer belt 11 and form yellow, magenta, cyan, and black toner images, respectively. These four image forming units IP are configured substantially similarly to one another except for a difference in the color of the toner used for development, and therefore FIG. 1 schematically illustrates only one image forming unit IP as a representative of them.

The above-described intermediate transfer belt 11 is stretched by three rollers, namely, a driving roller 12, a tension roller 13, and a secondary transfer inner roller 15. The toner images of the respective colors formed by the above-described four image forming units IP are superimposed on one another on this intermediate transfer belt 11, by which a full-color toner image is formed. Further, a secondary transfer outer roller 16 is arranged at a position facing the secondary transfer inner roller 15 in a manner sandwiching the intermediate transfer belt 11 therebetween, and the secondary transfer nip T2 is formed by a pair of these secondary transfer rollers 15 and 16 and the intermediate transfer belt 11.

The image forming unit IP includes a photosensitive drum 17, which is a drum-type electrophotographic photosensitive member, and is constructed with a primary charger 19, a scanner unit 20, a development device 21, a primary transfer roller 22, a cleaning device 23, and the like arranged around this photosensitive drum 17. The photosensitive drum 17 includes a support shaft (not illustrated) at a center thereof, and is configured to be rotationally driven around this support shaft in a direction indicated by an arrow R1 by a not-illustrated diving unit.

The primary charger 19 is in contact with a surface of the photosensitive drum 17 to serve to uniformly and evenly charge this surface so that this surface has a predetermined polarity and potential, and is configured to have a roller shape as a whole (hereinafter referred to as a charging roller). This charging roller 19 is in pressure contact with the surface of the photosensitive drum 17 with a predetermined pressing force, and rotates by being driven by the rotation of the photosensitive drum 17 in the direction indicated by the arrow R1. Further, a bias voltage is applied to a core metal of the charging roller 19 by a charging bias power source (not illustrated), which allows the charging roller 19 to uniformly and evenly contact and charge the surface of the photosensitive drum 17.

In the present exemplary embodiment, a bias voltage acquired by superimposing a direct-current voltage and an alternating-current voltage of 1.5 kVpp is applied to the core metal of the charging roller 19. Applying the alternating-current voltage allows the potential on the photosensitive drum 17 to be converged to the same value as the voltage of the direct-current voltage. For example, at the time of the direct-current voltage=−600 V, the surface of the photosensitive drum 17 has a potential of −600 V after being charged.

The scanner unit 20 is arranged on a downstream side of the charging roller 19 in the rotational direction of the photosensitive drum 17, and forms an electrostatic latent image on the photosensitive drum 17 by irradiating the photosensitive drum with laser light according to an image signal. An intensity of the laser light of the scanner unit 20 can be changed in a range from 0 to 255, and a potential of the latent image can be changed by changing the laser light intensity. In the present exemplary embodiment, V(L) represents the potential on the photosensitive drum 17 when the laser light intensity L is changed between 0 and 255 (V(L=0) to V(L=255)).

The development device 21 is arranged on a downstream side of the scanner unit 20, and employs a two-component developing method using a two-component developer including non-magnetic toner (negatively charged toner in the present exemplary embodiment) and a magnetic carrier. Then, the development device 21 is configured to develop the electrostatic latent image formed on the photosensitive drum 17 with the toner. In other words, the development device 21 serves as a development unit that develops the electrostatic latent image into the toner image with use of the developer including the toner and the carrier.

The primary transfer roller 22 is arranged on a downstream side of the development device 21 in a manner facing the photosensitive drum 17 while sandwiching the intermediate transfer belt 11 therebetween, and both ends thereof are biased toward the photosensitive drum 17 by a not-illustrated pressing member such as a spring. Then, a primary transfer nip T1, which transfers the toner image formed on the photosensitive drum 17 onto the intermediate transfer belt 11, is formed by the above-described primary transfer roller 22, photosensitive drum 17, and intermediate transfer belt 11. In the present exemplary embodiment, an image bearing member, which bears the toner image developed by the development unit, is formed by these photosensitive drum 17 and intermediate transfer belt 11.

The cleaning device 23 is arranged on a downstream side of the primary transfer roller 22, and is configured to remove toner remaining on the photosensitive drum 17 with use of a cleaning blade. A cleaning device 25, which removes toner remaining on the intermediate transfer belt 11 with use of a cleaning blade, is also arranged on the intermediate transfer belt 11 on a downstream side of the secondary transfer inner roller 15 in the rotational direction of the belt 11.

Figure 2:
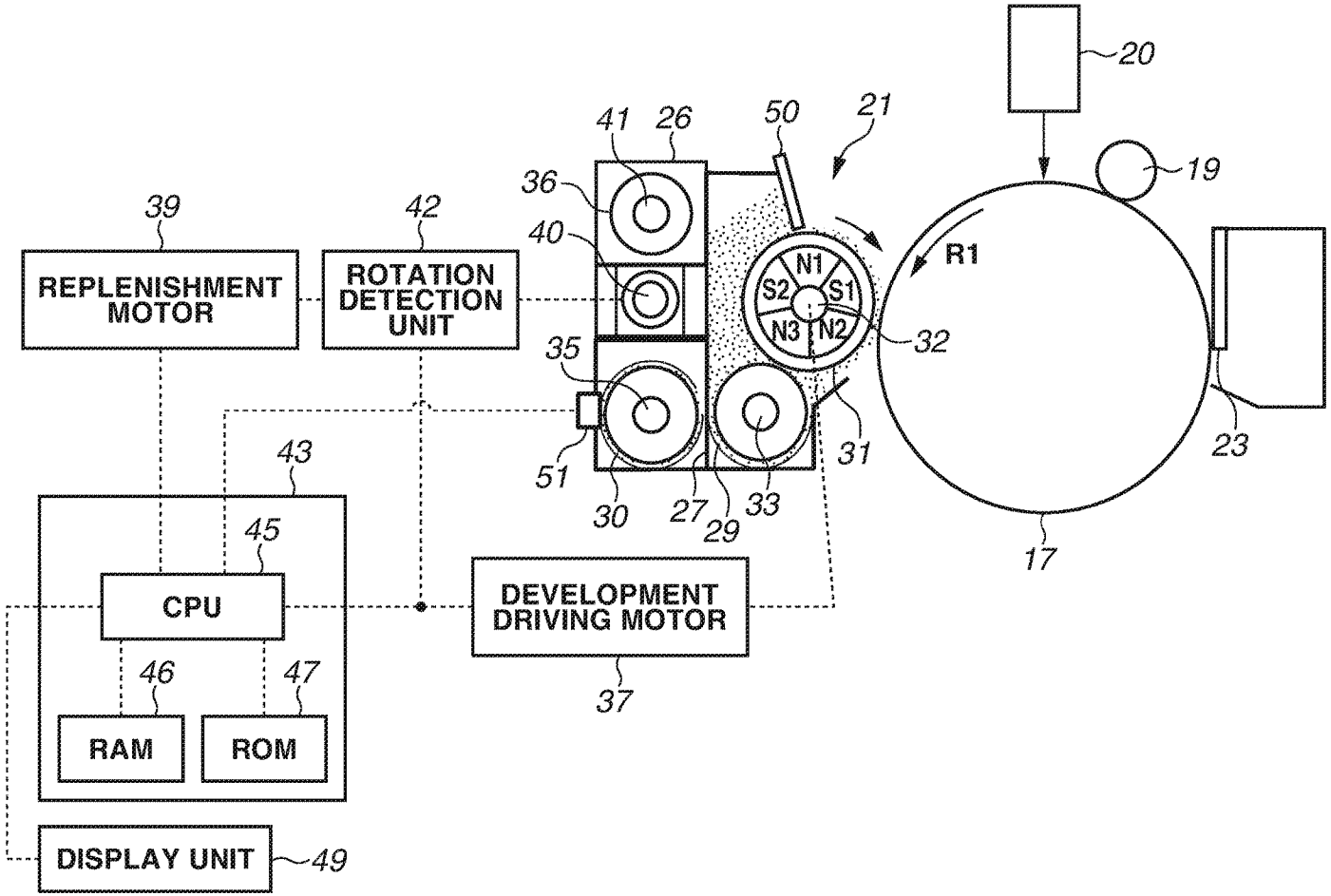
FIG. 2 is a schematic diagram illustrating a structure of a development device according to the first exemplary embodiment.

A configuration of the development device 21 will be described in detail with reference to FIG. 2. As illustrated in FIG. 2, the development device 21 employing the two-component developing method is configured in such a manner that an inside of a development device main body (a developer containing unit) 26 containing the developer therein is divided into a development chamber 29 and an agitation chamber 30 by a vertically extending partition wall 27. The above-described development device main body 26 is formed so as to be partially opened in the development chamber 29, and a non-magnetic development sleeve 31 as a developer bearing member is disposed at this opening. A part of the development sleeve 31 is exposed from the above-described opening, and faces the above-described photosensitive drum 17. Further, a magnet 32 as a magnetic field generation unit is fixedly arranged inside the development sleeve 31. The magnet 32 has approximately three or more poles, and a magnet having five poles is used in the present exemplary embodiment.

In addition, first and second conveyance screws 33 and 35, which are driven by a development driving motor 37, are disposed in the development chamber 29 and the agitation chamber 30, respectively, as a developer agitation unit that agitates and conveys the developer. A developer passage, which establishes communication between the development chamber 29 and the agitation chamber 30, is formed in the partition wall 27 at each of ends on a closer side and a remote side, and rotations of the first and second conveyance screws 33 and 35 cause the developer to be circulated and conveyed in the development device main body 26. More specifically, the rotation of the first conveyance screw 33 in the development chamber 29 causes the developer to be supplied to the development sleeve 31, and, along therewith, the developer having a reduced toner density due to consumption of the toner by the development to be conveyed to the agitation chamber 30. Further, the rotation of the second conveyance screw 35 causes toner supplied from a toner bottle 36 and the developer already present in the development device 21 to be agitated and conveyed, thereby allowing the developer to regain an even toner density. Then, the developer having the recovered toner density is supplied to the development chamber 29.

The development device 21 is configured in such a manner that the above-described toner bottle 36 is attachable thereto, and a rotation of a lower toner conveyance screw 40 causes the toner to be replenished into the agitation chamber 30 of the development device 21 via a replenishment port. Further, at this time, an upper toner conveyance screw 41 also rotates at the same time, and toner located at an upper portion is conveyed. In the present exemplary embodiment, a toner replenishment unit, which replenishes the toner into the development unit, includes the toner bottle 36, lower toner conveyance screw 40, upper toner conveyance screw 41, and a replenishment motor 39 that rotationally drives the toner conveyance screws 40 and 41. Rotational control of the replenishment motor 39 can be detected for each rotation of the screw by a rotation detection unit 42, and a central processing unit (CPU) 45 of a control unit 43 performs control of driving the replenishment motor 39 by an amount corresponding to a predetermined number of times of screw rotation. Further, the control unit 43 includes a random access memory (RAM) 46 and a read only memory (ROM) 47 as a storage unit in addition to the CPU 45. Further, the CPU 45 is connected to an interface 49 of the printer 1.

The two-component developer agitated by the first conveyance screw 33 in the development device 21 is caught by a magnetic force of a conveyance magnetic pole (a pumping pole) N3 for pumping, and is conveyed by a rotation of the development sleeve 31. The developer is sufficiently caught by a conveyance magnetic pole (a cutting pole) S2 having some predetermined or higher magnetic flux density, and is conveyed while forming a magnetic brush. Subsequently, the magnetic brush is cut by a regulation blade 50, and this allows the developer borne on the development sleeve 31 to have an appropriate layer pressure. Then, this borne developer is conveyed to a development region facing the photosensitive drum 17 according to the rotation of the development sleeve 31 while being borne by a conveyance magnetic pole Ni. Then, a magnetic brush is formed by a development pole S1 located in the development region, and only the toner is transferred onto the electrostatic image on the photosensitive drum 17 due to a development bias applied to the development sleeve 31, as a result of which the toner image according to the electrostatic image is formed onto the surface of the photosensitive drum 17.

The above-described development bias is applied to the development sleeve 31 by a development bias power source (not illustrated) serving as a development bias output unit. In the present exemplary embodiment, a development bias voltage acquired by superimposing a direct-current voltage (Dev DC=−500V) and an alternating-current voltage Dev AC=1.3 (KVpp 10 KHz) is applied to the development sleeve 31 from the development bias power source.

[Toner Replenishment Control: Video Count ATR and Developer Density Detection ATR]

Subsequently, toner replenishment control will be described. A toner density in the developer in the development device 21 is reduced due to the development of the electrostatic latent image. Therefore, the control unit 43 as a density control device performs control of replenishing the toner from the toner bottle 36 into the development device 21 (the toner replenishment control). By this control, the toner density in the developer is controlled to be kept as constant as possible, or an image density is controlled to be kept as constant as possible. More specifically, in the present exemplary embodiment, the replenishment control is performed based on two pieces of information. In the following description, the replenishment control will be described, by way of example, referring to a replenishment amount when an image for an N-th sheet is formed.

First, the video count ATR, which determines a toner amount consumed by the development carried out once, will be described. The video count ATR calculates a video count value: Vc from image information of an N-th output product, and calculates a video count replenishment amount: M_Vc by multiplying the calculated video count value by a coefficient: A_Vc according to an equation 1.

[Equation 1]

$$M_Vc(N)=Vc\times A_Vc \qquad \text{(Equation 1)}$$

The video count value Vc is 1023 when an image having an image ratio of 100% (i.e., an entirely solid black image) is output, and the video count value Vc changes according to the image ratio.

Next, the developer density detection ATR, which determines a deviation amount of the toner density at the time of the development from a target value, will be described. The TD ratio, which is the toner density in the developer in the development device 21 (in the developer containing portion 26), is detected by an inductance sensor 51 (refer to FIG. 2) which is a toner density detection unit provided in the agitation chamber 30. The developer density detection ATR first calculates a difference value between a TD ratio calculated from a result of the detection by the inductance sensor 51 with respect to an N−1-th sheet: TD_Indc(N−1), and a target TD ratio: TD_target. Then, the developer density detection ATR calculates an inductance replenishment amount M_Indc(N) by multiplying this difference value by a coefficient: A_Indc, as indicated by an equation 2.

[Equation 2]

$$M_\mathrm{Indc}(N)=(TD_\mathrm{target}-TD_\mathrm{Indc}(N-1))\times A_\mathrm{Indc} \qquad \text{(Equation 2)}$$

The above-described coefficients: A_Vc and A_Indc are each stored in the ROM 47 in advance. In the present exemplary embodiment, if the TD ratio is 8.0%, the TD ratio is stored as 8.0 in a case where it is stored into the RAM 46, and the toner replenishment amount is managed based on a unit of mg. Further, A_Indc is set to 200 and stored in the ROM 47 as that.

Then, a toner replenishment amount for the N-th sheet: M(N) is calculated from the above-described video count replenishment amount: M_Vc and the inductance replenishment amount: M_Indc(N) according to an equation 3.

[Equation 3]

$$M(N)=M_Vc(N)+M_\mathrm{Indc}(N)+M_\mathrm{remain}(N-1) \qquad \text{(Equation 3)}$$

In the equation 3, M_remain(N−1) represents a remaining replenishment amount which failed to be replenished in the replenishment when an image for the N−1-th sheet is formed. The remaining replenishment amount arises because a replenishment amount falls short of an amount corresponding to one rotation and the toner is replenished based on one rotation of the screw. In the Equation 3, this remaining replenishment amount is added to obtain M(N). Further, if a negative value is acquired as the toner replenishment amount: M (M<0), M is set to M=0.

After the toner replenishment amount M is determined, the control unit 43 calculates the number of times: B that the replenishment motor 39 rotates from this toner replenishment amount M. Because an amount of the toner: T replenished into the development device 21 when the lower toner conveyance screw 40 rotates once is stored in the ROM 47 in advance, the number of times: B that the replenishment motor 39 rotates is calculated according to an equation 4.

[Equation 4]

$$B=M/T \qquad \text{(Equation 4)}$$

In the present exemplary embodiment, the number of times: B that the replenishment motor 39 rotates is rounded down to the nearest whole number. Further, a maximum value is set to B=5 due to a constraint derived from a rotational speed of the replenishment rotor 39. A toner replenishment amount corresponding to a remainder when the number of times: B that the replenishment motor 39 rotates is 5 or more (B≥5) and that corresponding to a decimal fraction of B are not used for the replenishment, and therefore the above-described remaining replenishment amount: M_remain is calculated according to an equation 5.

[Equation 5]

$$M_remain = M - B \times T \quad \text{(Equation 5)}$$

Then, the control unit 43 replenishes the toner by rotationally driving the replenishment motor 39 as many times as B calculated according to the equation 4 when the image for the N-th sheet is formed.

[Toner Replenishment Control: Patch Detection ATR]

Figure 3:
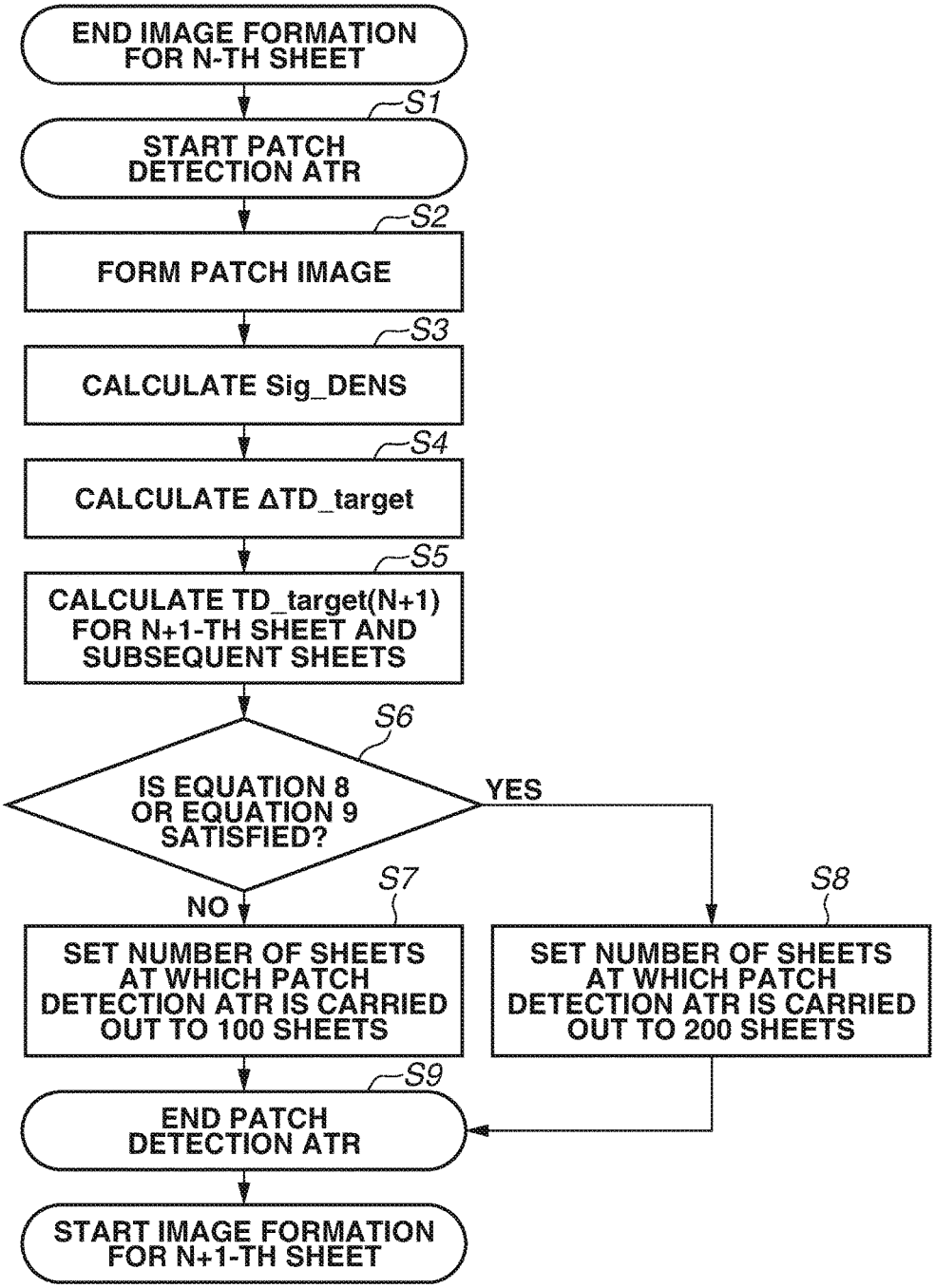
FIG. 3 is a flowchart illustrating patch detection Automatic Toner Replenishment (ATR) according to the first exemplary embodiment.
Figure 4:
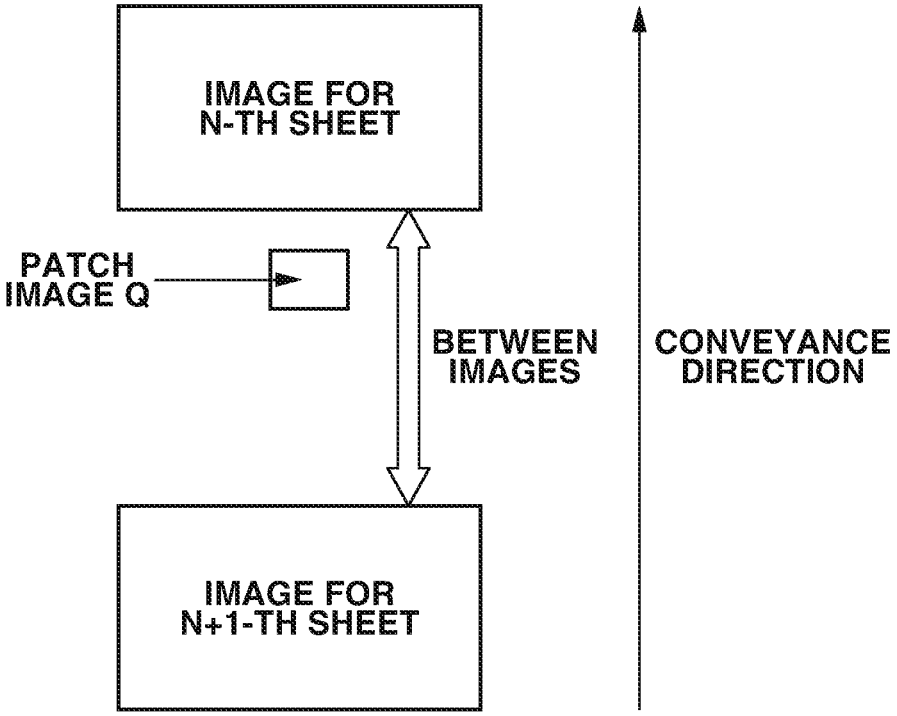
FIG. 4 is a schematic diagram illustrating a patch image.

Subsequently, the patch detection ATR will described with reference to FIGS. 3 and 4. The patch detection ATR is carried out as density adjustment control of forming a reference toner image for image density control (a density detection image) on the image bearing member and changing a target value of the toner density based on an image density of the reference toner image detected by the patch detection sensor 52. The patch detection ATR has a function as a target value setting unit because the patch detection ATR changes the above-described target TD ratio: TD_target stored in the RAM 46. More specifically, as illustrated in FIG. 3, in step S1, the control unit 43 starts the patch detection ATR upon an elapse of a downtime provided between end of the image formation for the N-th sheet and start of image formation for an N+1-th sheet. After the patch detection ATR is started, in step S2, the control unit 43 forms a patch image Q on the intermediate transfer belt 11 between the image for the N-th sheet and the image for the N+1-th sheet after the image for the N-th sheet is formed, as illustrated in FIG. 4. This patch image Q is formed constantly with use of the same latent image since an initial state regardless of a use state (a durability state) of the development device 21.

After the above-described patch image Q is formed, in step S3, a reflection density: Sig_DENS of the patch image Q is detected by a patch detection sensor 52 as an image density detection unit that detects the density of the toner image on the image bearing member. This patch detection sensor 52 detects the reflection density of the toner image on the intermediate transfer belt 11. The reflection density: Sig_DENS of the patch image Q has such a tendency that a numeral value thereof increases as the patch image Q becomes darker, and is quantified in a range from 0 to 1023. Then, in step S4, the control unit 43 calculates ΔTD_target, which is a range of a change in the TD ratio required to allow the reflection density of the formed toner image to match the initial state, according to an equation 6.

[Equation 6]

$$\Delta TD_target = \{Sig_DENS(INIT) - Sig_DENS\}/\alpha \quad \text{(Equation 6)}$$

The above-described variable Sig_DENS(INIT) represents a reflection density of the patch image Q recorded into the RAM 46 when the development device 21 is in the initial state, and a represents an amount of a change in Sig_DENS when the TD ratio is changed by 1%. In the present exemplary embodiment, α and Sig_DENS(INIT) are α=50 and Sig_DENS(INIT)=400, respectively, so that, in the case of Sig_DENS=375, ΔTD_target=0.5 is acquired and the TD ratio is determined to have to be increased by 0.5%.

After ΔTD_target is calculated, in step S5, the control unit 43 calculates a target TD ratio: TD_target(N+1) for the N+1-th sheet and subsequent sheets after the patch detection ATR according to an equation 7.

[Equation 7]

$$TD_target(N+1) = TD_target(N) + \Delta TD_target \quad \text{(Equation 7)}$$

[Upper and Lower Limit Values of Target TD Ratio]

Subsequently, upper and lower limit values of the target TD ratio will be described. As described above, the patch detection ATR can change the value of the target TD ratio: TD_target(N+1) based on the reflection density of the actually formed patch image Q. However, excessively increasing this target TD ratio may cause fogging on a white base, and excessively reducing the target TD ratio may cause attachment of the carrier or the like. Therefore, in the present exemplary embodiment, the upper and lower limit values are set on the target TD ratio. More specifically, in the present exemplary embodiment, the upper limit value and the lower limit value are set to 12% and 6%, respectively, and therefore the value of TD_target(N+1) is calculated as indicated by the following equations 8 and 9.

[Equation 8]

$$\text{For } TD_target(N+1) > 12, TD_target(N+1) = 12 \quad \text{(Equation 8)}$$

[Equation 9]

$$\text{For } TD_target(N+1) < 6, TD_target(N+1) = 6 \quad \text{(Equation 9)}$$

[Frequency of Execution of Patch Detection ATR]

Subsequently, frequency of the execution of the above-described patch detection ATR will be described. The patch detection ATR is configured to be carried out every time images are formed on a predetermined number of sheets (every 100 sheets in the present exemplary embodiment). In other words, in the present exemplary embodiment, if carrying out the patch detection ATR after the image for the N-th sheet is formed, the control unit 43 next carries out the patch detection ATR after an image for an N+100-th sheet is formed.

Figure 5A:
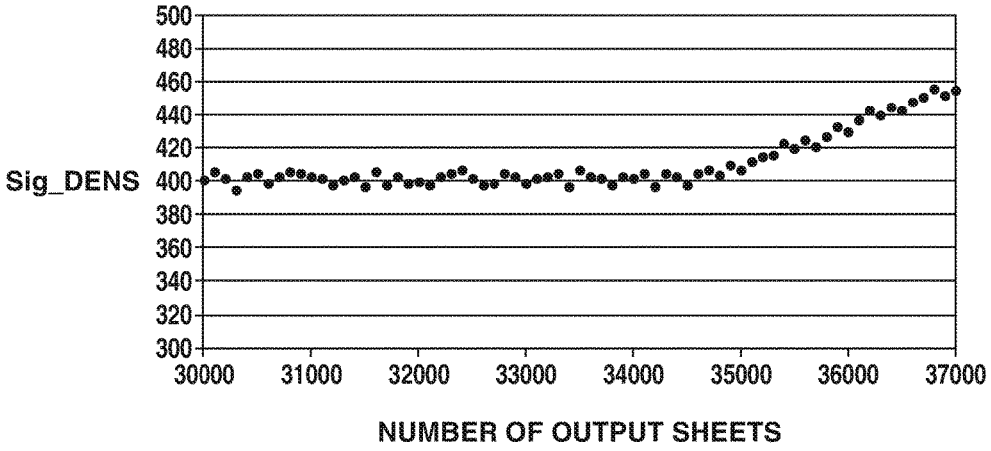
FIGS. 5A and 5B are diagrams illustrating transition of a reflection density of the patch image and a target toner density.
Figure 5B:
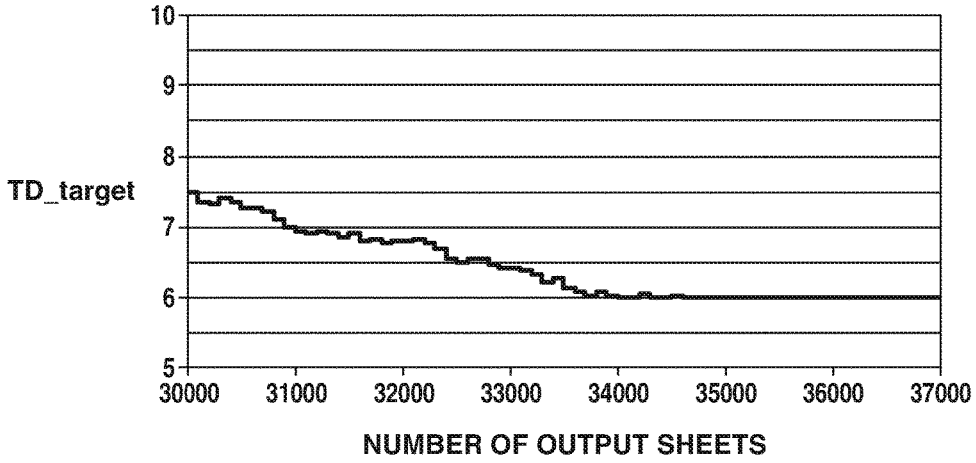

FIG. 5A illustrates a transition of the reflection density: Sig_DENS of the patch image Q and FIG. 5B illustrates a transition of the target TD ratio: TD_target (FIG. 5B) when and after the number of output sheets is 30000, in the case where the patch detection ATR is carried out simply every 100 sheets. FIG. 5 shows that reducing the target TD ratio: TD_target allows the reflection density: Sig_DENS of the patch image Q to be kept around the target value: Sig_DENS (INIT)=400 as far as approximately 34000 sheets. However, when and after the number of output sheets is 34000, the target TD ratio: TD_target cannot be reduced to 6% or lower, so that the value of the reflection density: Sig_DENS of the patch image Q is undesirably increased. This indicates that a reduction in the frictionally charged amount of the toner due to deterioration of the developer through usage cannot be absorbed by the TD ratio, and therefore the frictionally charged amount of the toner is reduced. Consequently, the reflection density of the patch image Q is increased.

In such a state where the target TD ratio: TD_target is reduced to the lower limit value 6%, the TD ratio is not adjusted regardless of how much the value of the reflection density: Sig_DENS of the patch image Q is increased. Therefore, even if the patch detection ATR is carried out in this state, this execution itself is a wasteful operation. The execution of the patch detection ATR requires the printer 1 to interrupt the image formation to form the patch image Q, which means an undesirable reduction in productivity of the printer 1. Further, the toner is also used to form the patch image, which undesirably advances deterioration of the development device 21 and the photosensitive drum 17. Therefore, it is desirable to refrain from carrying out the patch detection ATR when the execution thereof will end up as a wasteful operation, and carry out the patch detection ATR correctly when necessary.

Therefore, in the present exemplary embodiment, the control unit 43 is configured to, if the target TD ratio: TD_target matches the upper limit value or the lower limit value when carrying out the patch detection ATR, the number of sheets at which the next patch detection ATR is carried out is changed from 100 sheets (a first interval) to 200 sheets (a second interval). In this manner, the control unit 43 has a function as an interval setting unit that sets the number of sheets at which the patch detection ATR is carried out to the first interval or the second interval according to the target TD ratio: TD_target. In the present exemplary embodiment, the interval is the number of image formations. As another example, the interval may be a value corresponding to the number of image formation, such as a time period during which images are formed.

More specifically, as illustrated in FIG. 3, in step S6, the control unit 43 determines whether the equation 8 or the equation 9 is satisfied after TD_target(N+1) is determined. Then, if the above-described equation 8 or equation 9 is satisfied (YES in step S6), in step 8, the control unit 43 sets the number of sheets at which the next patch detection ATR is carried out to 200 sheets. On the other hand, if neither the equation 8 nor the equation 9 is satisfied (NO in step S6), in step S7, the control unit 43 sets the number of sheets at which the next patch detection ATR is carried out to 100 sheets. In other words, the control unit 43 is configured to limit the target value of the toner density within a predetermined range, and reduce the frequency of the execution of the density adjustment control based on the fact that this target value of the toner density is placed at a boundary value (a limit value) of the above-described predetermined range. Then, in step S9, the control unit 43 ends the patch detection ATR after determining whether to change the above-described number of sheets at which the patch detection ATR is carried out.

Figure 6A:
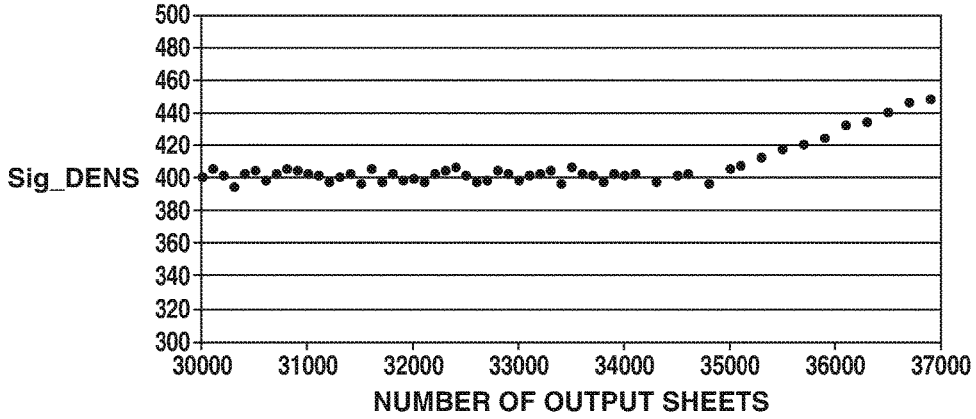
FIGS. 6A, 6B, and 6C are diagrams illustrating frequency of execution of the patch detection ATR according to the first exemplary embodiment.
Figure 6B:
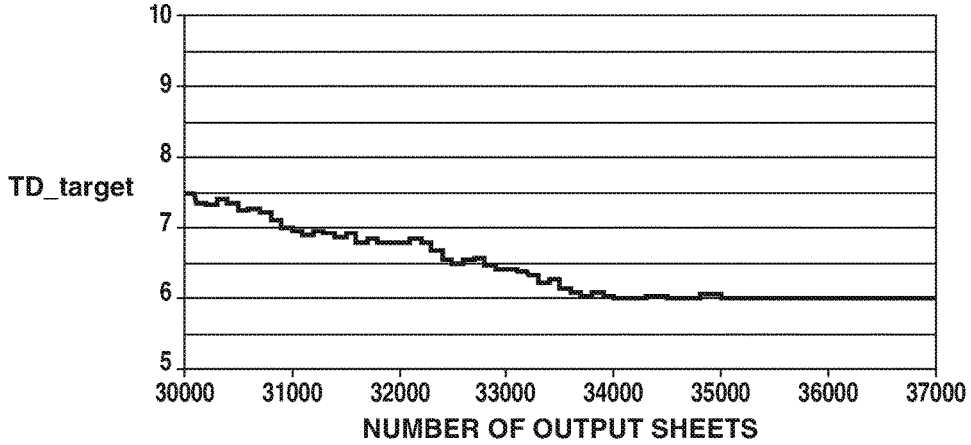
Figure 6C:
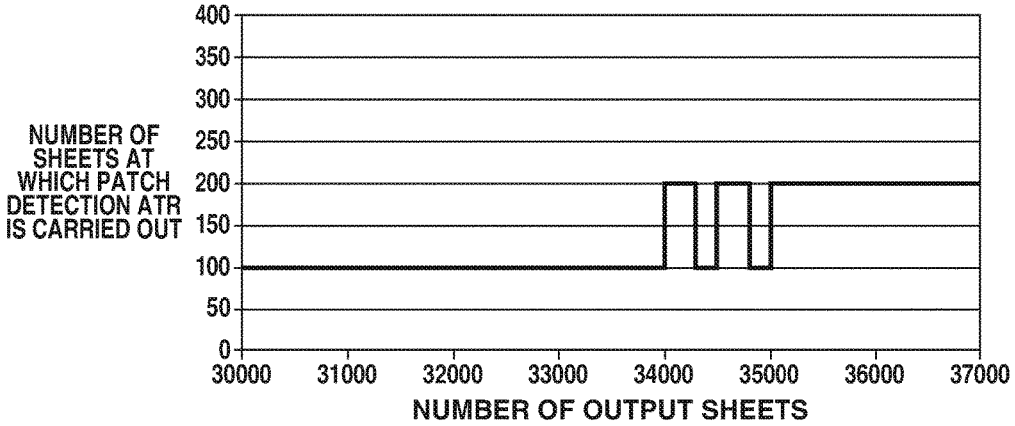

FIGS. 6A, 6B, and 6C respectively illustrate a transition of the reflection density of the patch image Q, a transition of the target TD ratio, and a transition of the number of sheets at which the next patch detection ATR is carried out when and after the number of output sheets is 30000, in the case where the above-described control is performed. From FIG. 6C, it can be understood that, when the target TD ratio: TD_target is the lower limit value 6%, the number of sheets at which the next patch detection ATR is carried out can be changed from 100 sheets to 200 sheets, and the frequency of the execution of the patch detection ATR can be reduced. Further, focusing on the number of times that the patch detection ATR is carried out since when the number of output sheets is 34000 until when the number of output sheets is 37000, it can be understood that the patch detection ATR is carried out 31 times in the case where the frequency is not changed, but this number of times can be reduced to 17 times in the control according to the present exemplary embodiment. Therefore, the patch detection ATR as the density adjustment control of changing the target value of the toner density can be carried out at a more appropriate timing. Even when or before the number of output sheets is 30000 (for example, at a time between 10000 to 20000 sheets), a charging performance of the developer may be reduced and the TD ratio may be reduced to the lower limit value in a case where an image having a high image duty is formed. Image duty is a toner amount transferred during one image formation. In this case, the control unit 43 also changes the frequency of the patch detection ATR in a similar manner.

[Correction of Laser Light Intensity when Target Value TD Ratio Matches Upper or Lower Limit]

Further, if the equation 8 or the equation 9 is satisfied, the target TD ratio: TD_target cannot be changed, and therefore the image density may be unintentionally changed due to the change in the frictionally charged amount of the toner. Therefore, in the present exemplary embodiment, if the equation 8 or the equation 9 is satisfied, the control unit 43 corrects the laser light intensity: L according to a difference value between Sig_DENS and Sig_DENS(INIT). A correction amount of this laser light intensity: ΔL is calculated according to an equation 10.

[Equation 10]

$$\Delta L=\{\text{Sig_DENS(INIT)}-\text{Sig_DENS}\}\times\beta \quad \text{(Equation 10)}$$

The above-described symbol β represents a correction coefficient. Then, when the patch detection ATR is carried out after the image for the N-th sheet is formed, a laser light intensity: L(N+1) for the N+1-th sheet is calculated by adding ΔL to an originally determined laser light intensity: L(init) as indicated by an equation 11.

[Equation 11]

$$L(N+1)=L(\text{init})+\Delta L \quad \text{(Equation 11)}$$

Subsequently, a second exemplary embodiment of the present invention will be described. In the above-described first exemplary embodiment, if the equation 8 or the equation 9 is satisfied, the number of sheets at which the next patch detection ATR is carried out is changed. In this case, the configuration according to the first exemplary embodiment leads to a uniform increase in the number of sheets at which the patch detection ATR is carried out even when the difference value between Sig_DENS(INIT) and Sig_DENS is small, thereby raising a possibility of accidentally missing a situation actually requiring the patch detection ATR control. For example, referring to FIGS. 6A, 6B, and 6C, in two cases, the number of sheets at which the patch detection ATR is carried out is returned to 100 sheets in view of a result of the next patch detection ATR after being increased to 200 sheets.

Therefore, in the second exemplary embodiment, the printer 1 is configured to change the number of sheets at which the next patch detection ATR is carried out if the equation 8 or the equation 9 is satisfied and the difference value between Sig_DENS(INIT) and Sig_DENS is also a predetermined value or larger. In the following description, the second exemplary embodiment will be described, focusing only on a difference from the first exemplary embodiment and omitting a description of a similar configuration to the first exemplary embodiment.

Figure 7:
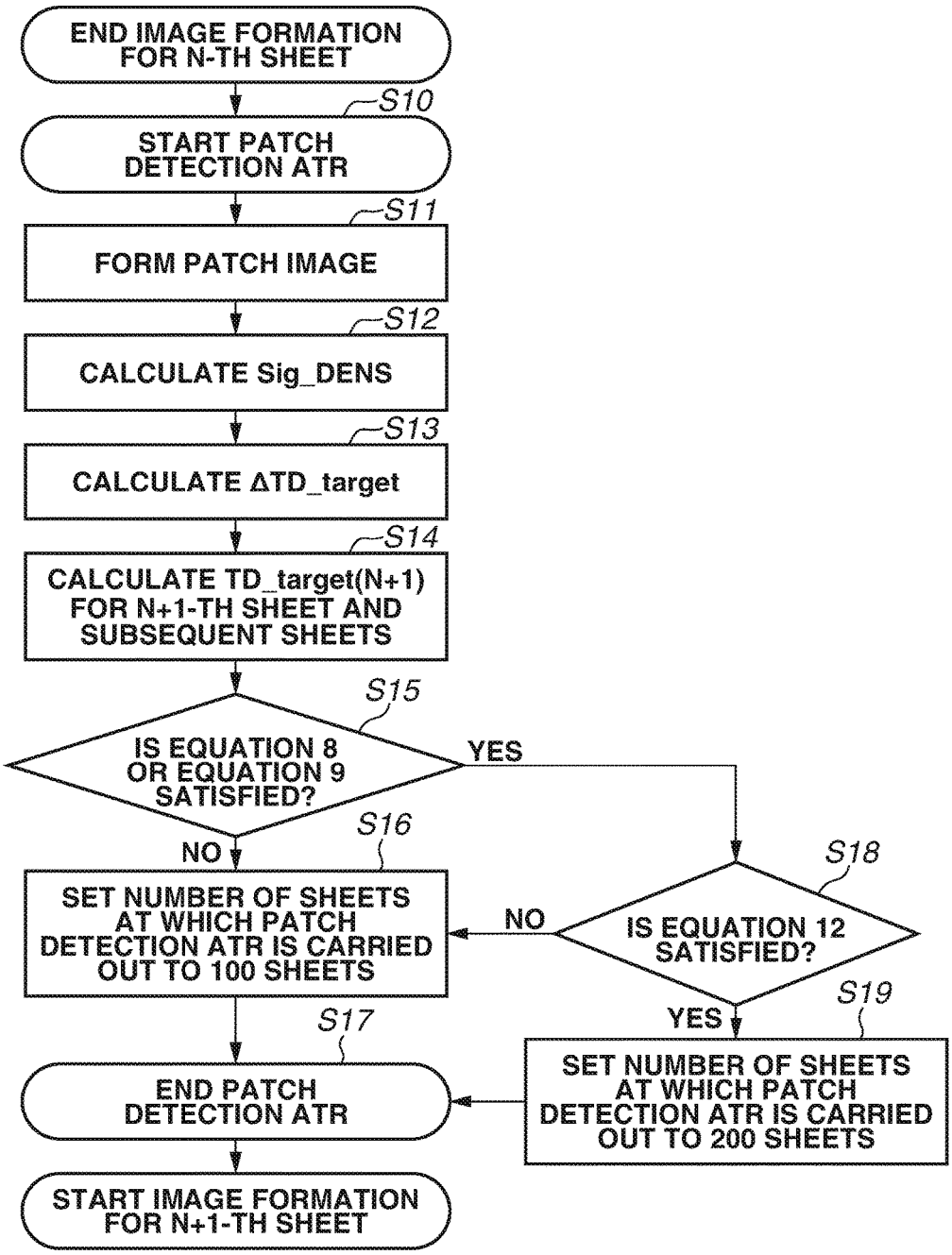
FIG. 7 is a flowchart illustrating the patch detection ATR according to a second exemplary embodiment.

As illustrated in FIG. 7, if the equation 8 or the equation 9 is satisfied and the target TD ratio: TD_target matches the upper limit value or the lower limit value (YES in step S15), in step S18, the control unit 43 determines whether an equation 12 is satisfied.

[Equation 12]

$$|\text{Sig_DENS}-\text{Sig_DENS(INIT)}|>10 \quad \text{(Equation 12)}$$

Then, if the above-described equation 12 is satisfied (YES in step S18), the control unit 43 sets the number of sheets at which the next patch detection ATR is carried out to 200 sheets. On the other hand, if the equation 12 is not satisfied (NO in step S18), the control unit 43 sets the number of sheets at which the next patch detection ATR is carried out to 100 sheets, even when the equation 8 or the equation 9 is satisfied. In other words, in the present exemplary embodiment, the control unit 43 changes the frequency of the execution of the patch detection ATR if the target value of the toner density is placed at the boundary value and the difference value between the toner density detected by the patch detection sensor 52 and the target value of this toner density is the predetermined value or larger. On the other hand, the control unit 43 refrains from changing the frequency of the execution of the patch detection ATR if the above-described difference value is smaller than the predetermined value even when the target value of the toner density is placed at the boundary value.

Figure 8A:
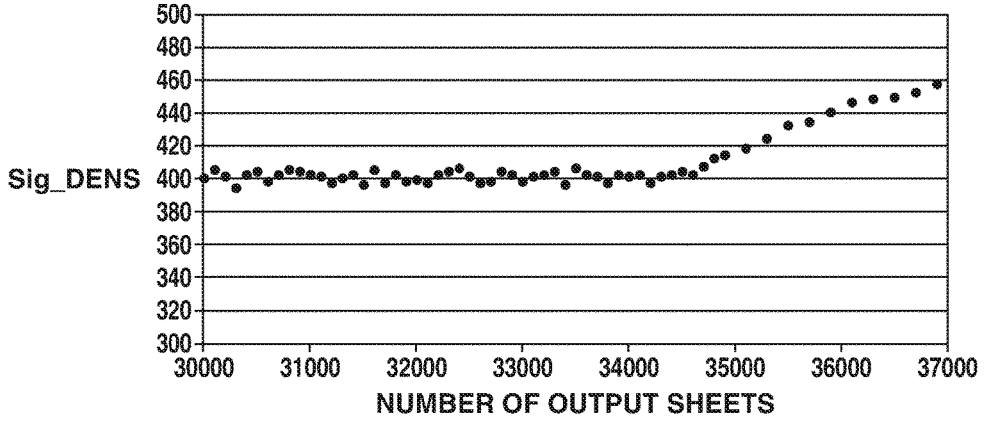
FIGS. 8A, 8B, and 8C are diagrams illustrating frequency of the execution of the patch detection ATR according to the second exemplary embodiment.
Figure 8B:
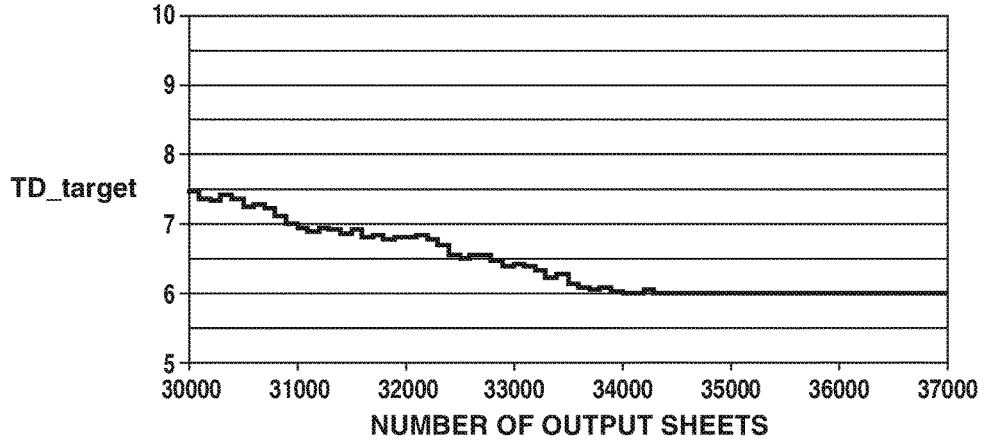
Figure 8C:
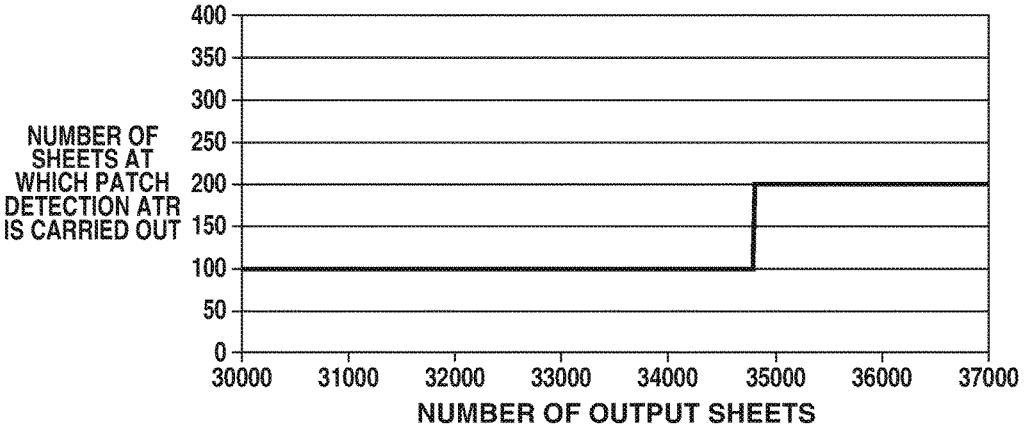

FIGS. 8A, 8B, and 8C respectively illustrate a transition of the reflection density: Sig_DENS of the patch image Q, a transition of the target TD ratio: TD_target, and a transition the number of sheets at which the next patch detection ATR is carried out when and after the number of output sheets is 30000. As illustrated in FIG. 8C, it can be understood that, when the target TD ratio: TD_target is the lower limit value 6% and the equation 12 is satisfied, the number of sheets at which the next patch detection ATR is carried out is changed from 100 sheets to 200 sheets, and the frequency of the execution of the patch detection ATR is reduced. Further, focusing on the number of times that the patch detection ATR is carried out since when the number of output sheets is 34000 until when the number of output sheets is 37000, the patch detection ATR is carried out 31 times in the case where the frequency is not changed, but this number of times can be reduced to 20 times in the control according to the present exemplary embodiment. It can be understood that, compared to the control according to the first exemplary embodiment, the number of times that the patch detection ATR is carried out is increased by 3, and the frequency of the patch detection ATR is kept unchanged when the difference value between Sig_DENS(INIT) and Sig_DENS is 10 or smaller. Further, in FIGS. 6A, 6B, and 6C, the number of sheets at which the patch detection ATR is carried out is returned to 100 sheets again after being changed to 200 sheets at some portions, and Sig_DENS falls below Sig_DENS(INIT) at these times. On the other hand, in FIGS. 8A, 8B, and 8C, the number of sheets at which the patch detection ATR is carried out can be kept at 100 sheets at these portions, and the change in Sig_DENS at these times are more stabilized than in FIG. 6A. Therefore, the present configuration can also achieve an advantageous effect in terms of stabilization of the image density.

A third exemplary embodiment will be described. In the first exemplary embodiment, if the predetermined condition is satisfied, the number of sheets at which the next patch detection ATR is carried out is uniformly changed from 100 sheets to 200 sheets. In this case, even when there is a significant difference between Sig_DENS(INIT) and Sig_DENS, the number of sheets at which the patch detection ATR is carried out remains 200 sheets, and therefore the frequency cannot be reduced more than that. Therefore, in the present exemplary embodiment, the printer 1 is configured to determine the frequency of the execution of the next patch detection ATR according to the difference value between Sig_DENS(INIT) and Sig_DENS if the equation 8 or the equation 9 is satisfied. In the following description, the third exemplary embodiment will be described, focusing only on a difference from the first exemplary embodiment and omitting a description of a similar configuration to the first exemplary embodiment.

Figure 9:
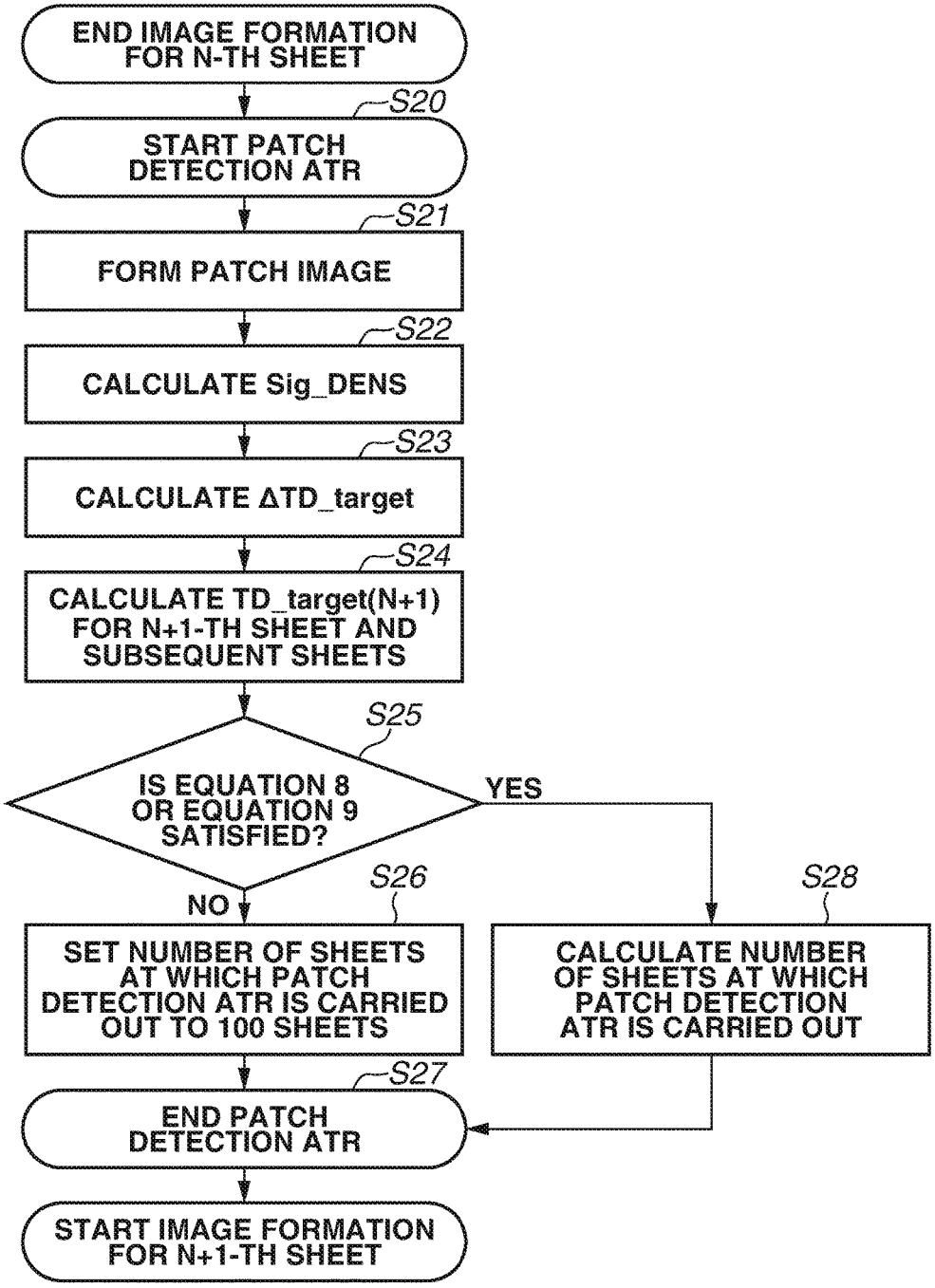
FIG. 9 is a flowchart illustrating the patch detection ATR according to a third exemplary embodiment.
Figure 10:
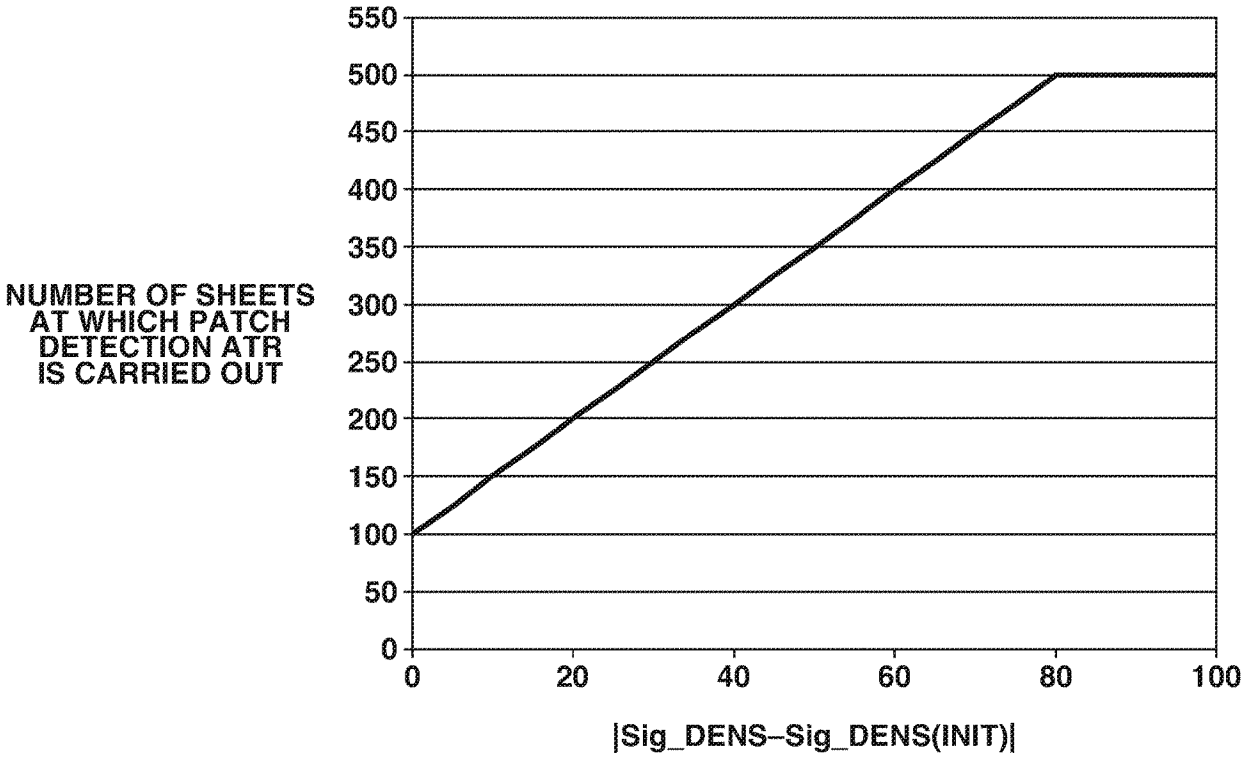
FIG. 10 is a diagram illustrating a relationship between a difference of the reflection density of the patch image from a target value and the number of sheets at which the patch detection ATR is carried out.

As illustrated in FIG. 9, if the target TD ratio: TD_target matches the upper limit value or the lower limit value (YES in step S25), in step S28, the control unit 43 calculates the frequency of the execution of the next patch detection ATR according to the difference value between Sig_DENS(INIT) and Sig_DENS. FIG. 10 illustrates a relationship between an absolute value of the difference value between Sig_DENS (INIT) and Sig_DENS: |Sig_DENS−Sig_DENS(INIT)| and the frequency of the execution of the next patch detection ATR. The relationship illustrated in FIG. 10 is recorded in the ROM 47, and the control unit 43 calculates the frequency of the execution of the next patch detection ATR according to this relationship. In a case of |Sig_DENS−Sig_DENS (INIT)|>100, the number of sheets at which the patch detection ATR is carried out is kept constant at 500 sheets. In other words, in the present exemplary embodiment, the control unit 43 is configured to change the range of the change in the frequency of the execution of the patch detection ATR according to the difference value between the toner density detected by the patch detection sensor 52 and the target value of the toner density when changing the frequency of the execution of the patch detection ATR.

Figure 11A:
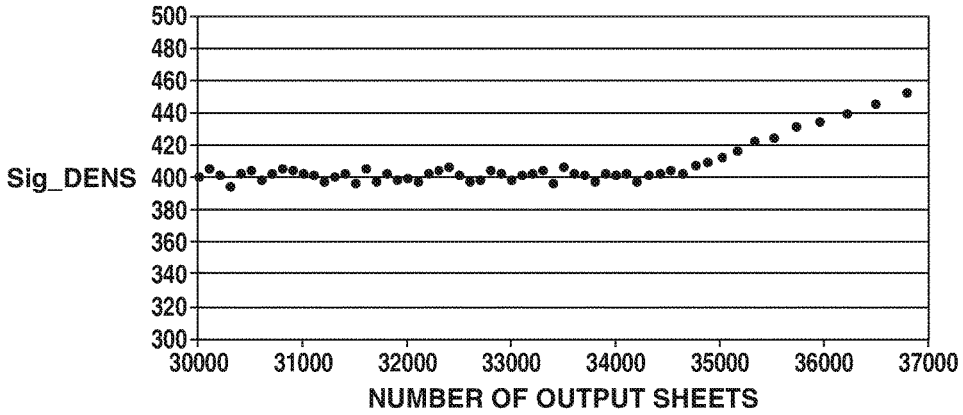
FIGS. 11A, 11B, and 11C are diagrams illustrating frequency of the execution of the patch detection ATR according to the third exemplary embodiment.
Figure 11B:
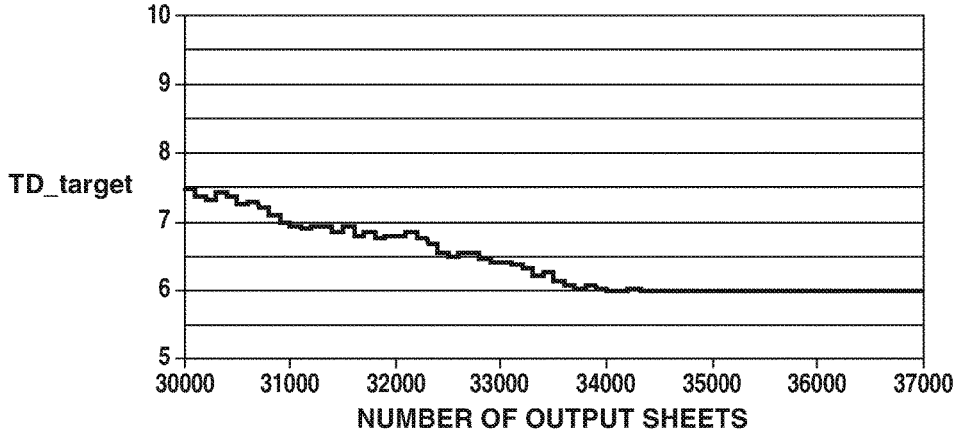
Figure 11C:
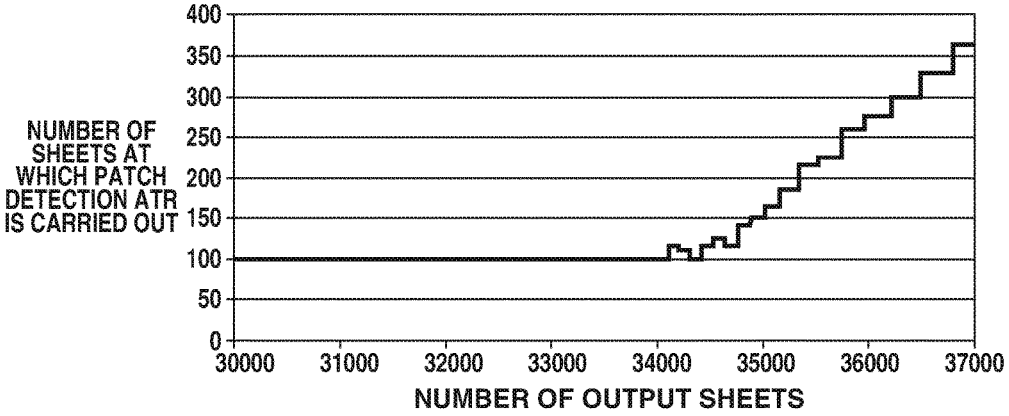

FIGS. 11A, 11B, and 11C respectively illustrate a transition of the reflection density: Sig_DENS of the patch image Q, a transition of the target TD ratio: TD_target, and a transition of the number of sheets at which the next patch detection ATR is carried out when and after the number of output sheets is 30000. From FIG. 11C, it can be understood that, when the target TD ratio: TD_target is the lower limit value 6%, the number of sheets at which the next patch detection ATR is carried out can be variably changed according to the relationship illustrated in FIG. 10, and the frequency of the execution of the patch detection ATR can be reduced. Focusing on the number of times that the patch detection ATR is carried out since when the number of output sheets is 34000 until when the number of output sheets is 37000, the patch detection ATR is carried out 31 times in the state that the frequency is not changed, but this number of times can be reduced to 18 times in the control according to the present exemplary embodiment. Further, the present configuration leads to a further reduction in the frequency of the execution of the patch detection ATR when and after the number of output sheets is 37000, due to a further increase in the number of sheets at which the patch detection ATR is carried out.

Figure 12:
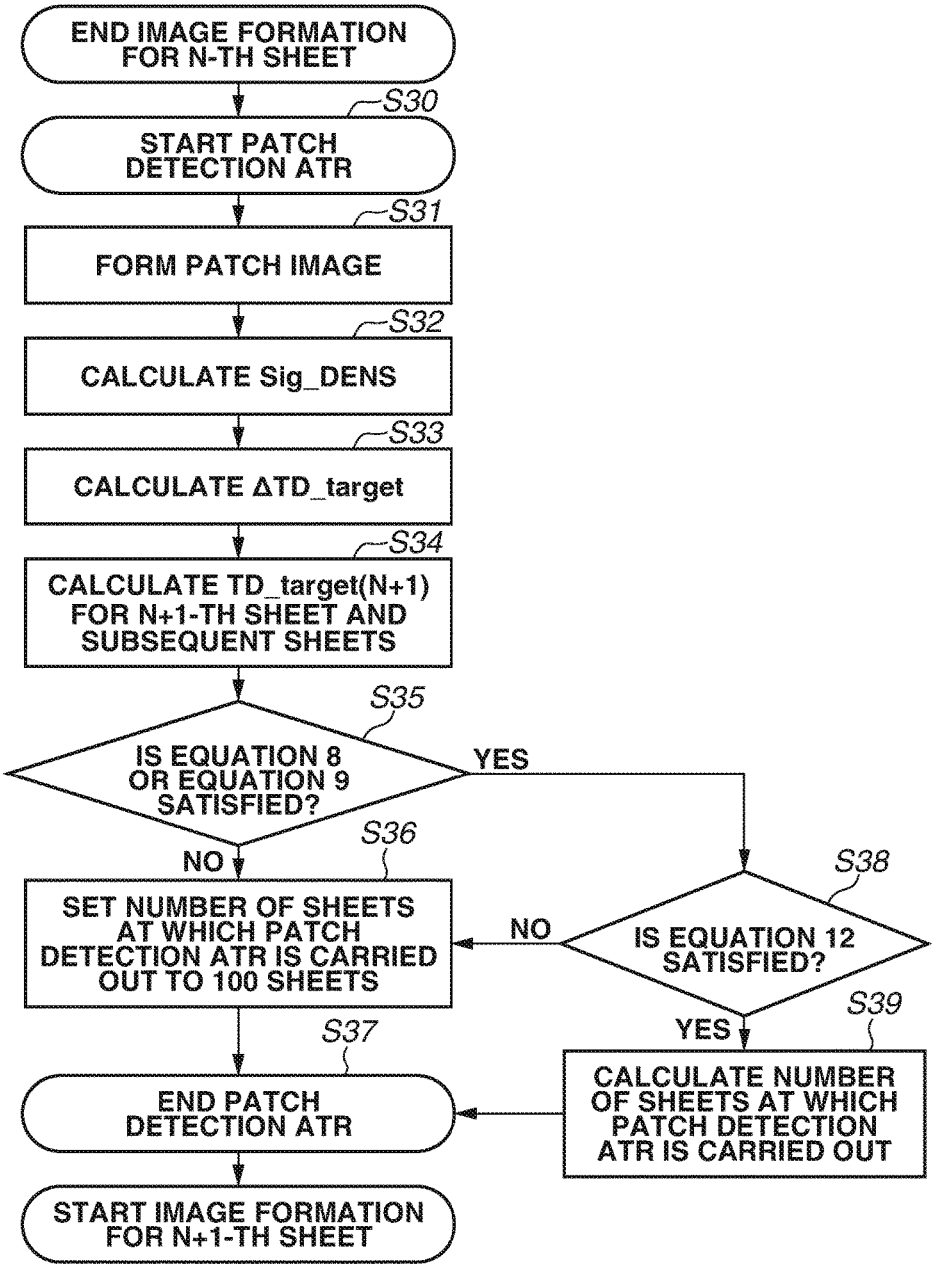
FIG. 12 is a flowchart of the patch detection ATR according to a fourth exemplary embodiment.

A fourth exemplary embodiment is constructed by combining the methods according to the above-described second and third exemplary embodiments, and, in the following description, will be described focusing only on a difference from the first exemplary embodiment and omitting a description of a configuration similar to the first exemplary embodiment. As illustrated in FIG. 12, if the equation 8 or the equation 9 is satisfied and the target TD ratio: TD_target matches the upper limit value or the lower limit value (YES in step S35), in step S38, the control unit 43 determines whether the above-described equation 12 is satisfied.

Figure 13:
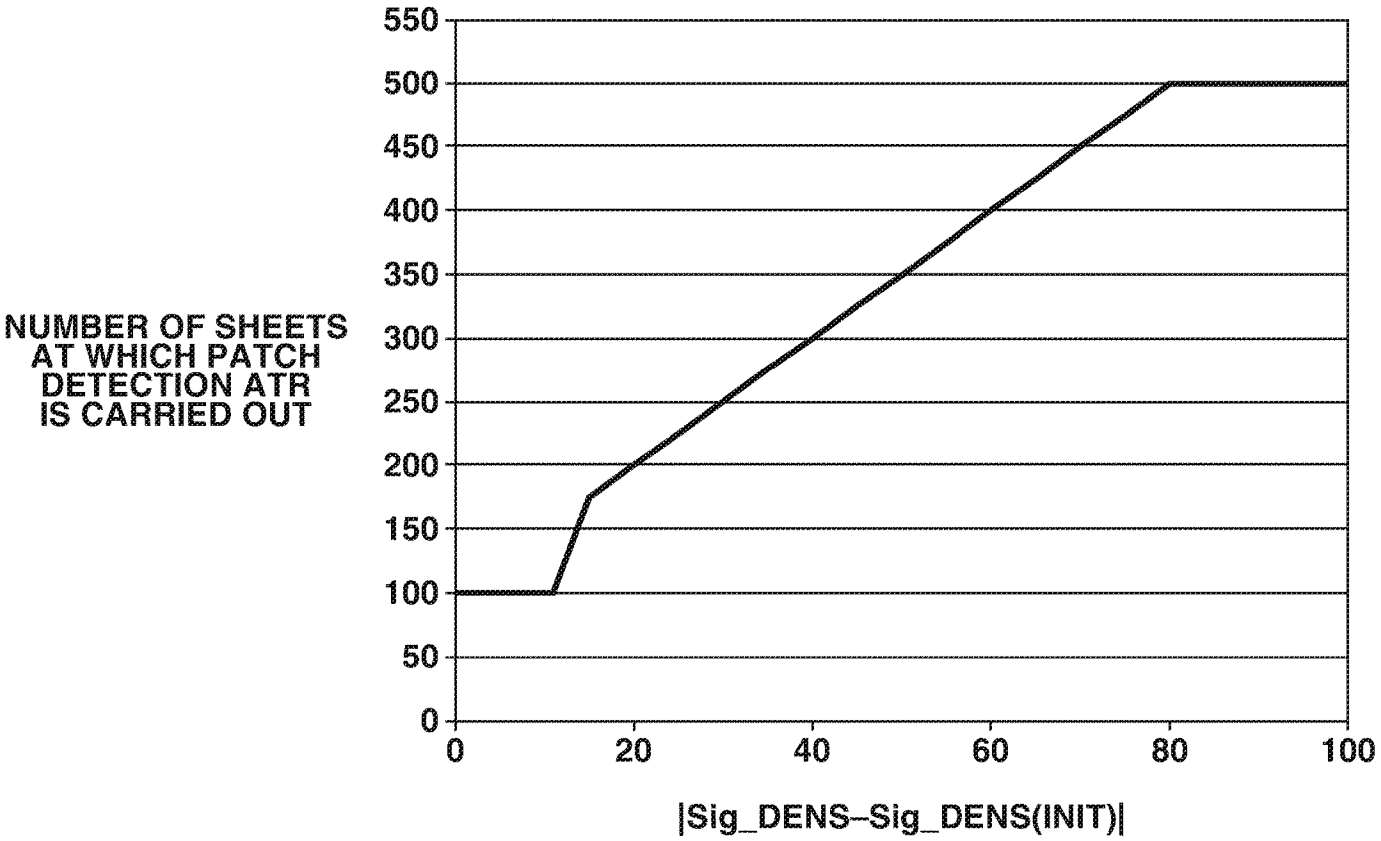
FIG. 13 is a diagram illustrating a relationship between the difference of the reflection density of the patch image from the target value and the number of sheets at which the patch detection ATR is carried out according to the fourth exemplary embodiment.

Then, if the equation 12 is satisfied (YES in step S38), next, in step S39, the control unit 43 calculates the frequency of the execution of the next patch detection ATR according to a relationship between the absolute value of the difference value between Sig_DENS(INIT) and Sig_DENS and the frequency of the execution of the next patch detection ATR (refer to FIG. 13), which is recorded in the ROM 47. In the case where |Sig_DENS−Sig_DENS(INIT)|>100, the number of sheets at which the patch detection ATR is carried out is kept constant at 500 sheets.

Figure 14A:
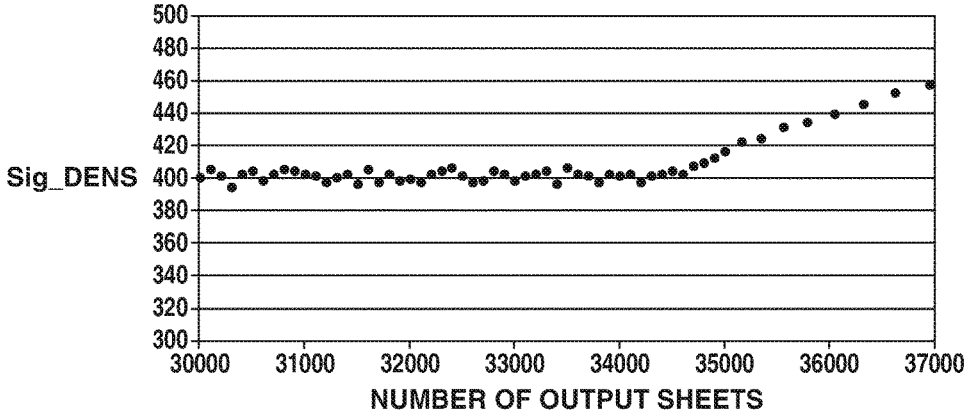
FIGS. 14A, 14B, and 14C are diagrams illustrating frequency of the execution of the patch detection ATR according to the fourth exemplary embodiment.
Figure 14B:
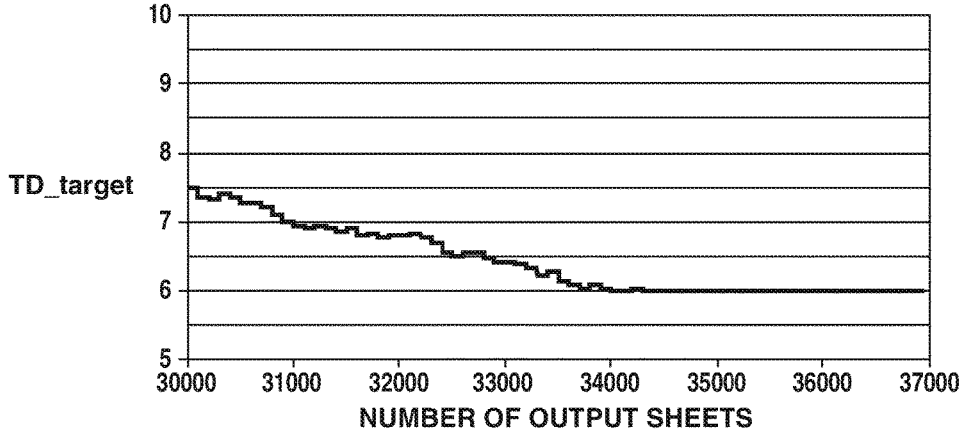
Figure 14C:
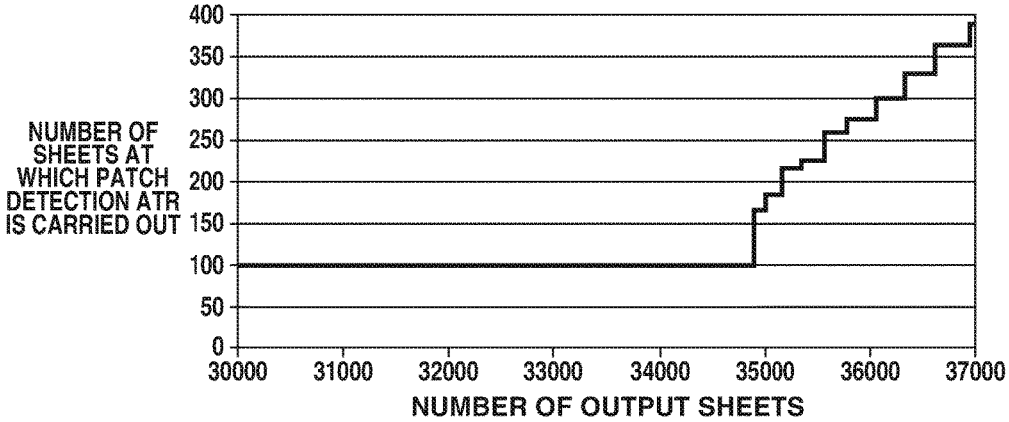

FIGS. 14A, 14B, and 14C respectively illustrate a transition of the reflection density: Sig_DENS of the patch image Q, a transition of the target TD ratio: TD_target, and transition of the number of sheets at which the next patch detection ATR is carried out when and after the number of output sheets is 30000. From FIG. 14C, it can be understood that, when the target TD ratio: TD_target is the lower limit value 6%, the number of sheets at which the next patch detection ATR is carried out can be variably changed according to the relationship illustrated in FIG. 13, and the frequency of the execution of the patch detection ATR can be reduced. Focusing on the number of times that the patch detection ATR is carried out since when the number of output sheets is 34000 until when the number of output sheets is 37000, the patch detection ATR is carried out 31 times in the case where the frequency is not changed, but this number of times can be reduced to 20 times in the control according to the present exemplary embodiment. Further, compared to the control according to the third exemplary embodiment, the number of times that the control is performed is increased by 2, and the present exemplary embodiment is configured to refrain from changing the frequency of the patch detection ATR if the difference value between Sig_DENS(INIT) and Sig_DENS is 10 or smaller.

The present invention is not limited to the above-described exemplary embodiments, and, for example, the control unit 43 may be configured to return the number of sheets at which the patch detection ATR is carried out to an original value if the environment (a temperature and/or a humidity) is changed by a predetermined degree or higher when the control unit 43 is increasing the number of sheets at which the patch detection ATR is carried out. Further, the control unit 43 may be configured to return the number of sheets at which the patch detection ATR is carried out to the original value if the image DUTY is changed by a predetermined amount or more when the control unit 43 is increasing the number of sheets at which the patch detection ATR is carried out, because the charging performance of the developer may be changed in this case.

Further, the above-described boundary value of the toner density is sufficiently usable as long as the boundary value includes at least one of the upper limit and the lower limit. Further, in the above-described exemplary embodiments, the image forming apparatus has been described based on the printer employing the intermediate transfer method by way of example, but the present invention can also be obviously applied to an image forming apparatus employing a direct transfer method that directly transfers an image onto a sheet. Further, the image forming apparatus to which the present invention is applied may be configured to superimpose the toner images on the photosensitive drum instead of superimposing the toner images on the intermediate transfer belt. Further, the invention described in the exemplary embodiments may be combined in any manner.

While the present invention has been described with reference to exemplary embodiments, it is to be understood that the invention is not limited to the disclosed exemplary embodiments.

This application claims the benefit of Japanese Patent Application No. 2017-007061, filed Jan. 18, 2017, which is hereby incorporated by reference herein in its entirety.

What is claimed is:

1. An image forming apparatus comprising:

a developer containing unit configured to contain therein a developer including toner and a carrier;

a developer bearing member configured to bear the developer in the developer containing unit;

a toner density detection unit configured to detect the density of the toner relative to the developer in the developer containing unit;

a toner replenishment unit configured to replenish the toner into the developer containing unit;

an image density detection unit configured to detect the density of density detection toner images developed by the developer bearing member at a preset interval;

a control unit configured to control the replenishing of toner, by the toner replenishment unit, into the developer containing unit so as to maintain toner density, detected by the toner density detection unit, at a target value;

wherein the control unit is further configured to set the target value of the toner density to a value that is a preset lower limit value or higher and a preset upper limit value or lower based on an output of the image density detection unit; and wherein the control unit is further configured to set the interval to the first interval when the target value is set to a value higher than the lower limit value and lower than the upper limit value, and to set the interval to a second interval greater than the first interval when the target value setting unit sets the target value to the upper limit value or the lower limit value.

2. The image forming apparatus according to claim 1, wherein the interval is the number of image formations.

3. The image forming apparatus according to claim 1, wherein the control unit is configured to set the interval to the second interval in a case where the toner density detected by the toner density detection unit is lower than the lower limit value and a difference therebetween is larger than a predetermined amount, and to set the interval to the first interval in a case where the toner density detected by the toner density detection unit is lower than the lower limit value and the difference therebetween is smaller than the predetermined value.

4. The image forming apparatus according to claim 1, wherein the control unit is configured to set the interval to the second interval in a case where the toner density detected by the toner density detection unit is higher than the upper limit value and a difference therebetween is larger than a predetermined amount, and to set the interval to the first interval in a case where the toner density detected by the toner density detection unit is higher than the upper limit value and the difference therebetween is smaller than the predetermined value.

5. The image forming apparatus according to claim 1, wherein the toner density detection unit is an inductance sensor.

6. The image forming apparatus according to claim 1, wherein the control unit is configured to calculate a video count of an image, and to control the replenishing of the toner, by the toner replenishment unit, into the developer containing unit based on a result of the calculation.

7. An image forming apparatus comprising:

a developer containing unit configured to contain therein a developer including toner and a carrier;

a developer bearing member configured to bear the developer in the developer containing unit;

a toner density detection unit configured to detect the density of the toner relative to the developer in the developer containing unit;

a toner replenishment unit configured to replenish the toner into the developer containing unit;

an image density detection unit configured to detect the density of density detection toner images developed by the developer bearing member every time the number of image formations reaches a preset number;

a control unit configured to control the replenishing of the toner, by the toner replenishment unit, into the developer containing unit so as to main toner density, detected by the toner density detection unit, at a target value; and a control unit configured to set the target value of the toner density to a value that is a preset lower limit value or higher and a preset upper limit value or lower based on an output of the image density detection unit;

wherein, when an image having a predetermined image ratio is successively formed, the density detection toner image is formed every time the number of image formations reaches a first number of image formations when the density of the toner has a value higher than the lower limit value and lower than the upper limit value, and the density detection toner image is formed every time the number of image formations reaches a second number of image formations that is greater than the first number of image formations when the density of the toner is the upper limit value or higher or the lower limit value or lower.

8. The image forming apparatus according to claim 7, wherein the second number of image formations is set in a case where the toner density detected by the toner density detection unit is the lower limit value or lower and a difference therebetween is larger than a predetermined amount, and the first number of image formations is set in a case where the toner density detected by the toner density detection unit is the lower limit value or lower and the difference therebetween is smaller than the predetermined amount.

9. The image forming apparatus according to claim 7, wherein the second number of image formations is set in a case where the toner density detected by the toner density detection unit is the upper limit value or higher and a difference therebetween is larger than a predetermined amount, and the first number of image formations is set in a case where the toner density detected by the toner density detection unit is the upper limit value or higher and the difference therebetween is smaller than the predetermined amount.

10. The image forming apparatus according to claim 7, wherein the toner density detection unit is an inductance sensor.

11. The image forming apparatus according to claim 7, wherein the control unit is configured to calculate a video count of an image, and to control the replenishing of the toner, by the toner replenishment unit, into the developer containing unit based on a result of the calculation.

* * * * *